US008739898B2

(12) United States Patent
Johnston et al.

(10) Patent No.: US 8,739,898 B2
(45) Date of Patent: Jun. 3, 2014

(54) APPARATUS AND METHODS FOR DETECTING GASES DURING CORING OPERATIONS

(75) Inventors: Paul Johnston, Houston, TX (US); Debbie Kercho, Houston, TX (US); Kevan Sincock, Houston, TX (US); Ray Wydrinski, Dallas, TX (US); Ross Benthien, Houston, TX (US)

(73) Assignee: BP Corporation North America Inc., Houston, TX (US)

( * ) Notice: Subject to any disclaimer, the term of this patent is extended or adjusted under 35 U.S.C. 154(b) by 438 days.

(21) Appl. No.: 13/083,021

(22) Filed: Apr. 8, 2011

(65) Prior Publication Data

US 2011/0247879 A1 Oct. 13, 2011

Related U.S. Application Data

(60) Provisional application No. 61/322,548, filed on Apr. 9, 2010.

(51) Int. Cl.
*E21B 49/02* (2006.01)

(52) U.S. Cl.
USPC ..... 175/58; 175/59; 175/244; 175/249; 166/264

(58) Field of Classification Search
USPC ..... 175/58, 59, 244, 249; 166/264, 250.11
See application file for complete search history.

(56) References Cited

U.S. PATENT DOCUMENTS

| | | | |
|---|---|---|---|
| 4,142,594 | A | 3/1979 | Thompson et al. |
| 4,258,803 | A | 3/1981 | Thompson et al. |
| 4,955,438 | A | 9/1990 | Juergens et al. |
| 5,230,390 | A | 7/1993 | Zastresek et al. |
| 5,417,295 | A | 5/1995 | Rao et al. |
| 6,003,620 | A | 12/1999 | Sharma et al. |
| 6,158,534 | A | 12/2000 | Fanuel |
| 6,341,656 | B1 | 1/2002 | Fanuel |
| 6,719,070 | B1 | 4/2004 | Puymbroeck et al. |
| 7,025,138 | B2 | 4/2006 | Kurkjian et al. |
| 7,878,269 | B2 | 2/2011 | Cravatte |
| 2002/0121370 | A1 | 9/2002 | Kurkjian et al. |
| 2006/0032301 | A1 | 2/2006 | DiFoggio |

FOREIGN PATENT DOCUMENTS

| | | | |
|---|---|---|---|
| GB | 2454699 | A | 5/2009 |

OTHER PUBLICATIONS

PCT International Search Report and The Written Opinion of the International Searching Authority, or the Declaration, mailed Aug. 24, 2011, in related International application No. PCT/US2011/031729, 13 pages.

*Primary Examiner* — Cathleen Hutchins
(74) *Attorney, Agent, or Firm* — Jayne C. Piana

(57) ABSTRACT

A method for detecting the presence of an acid gas in a formation fluid from a subterranean formation comprises (a) lowering a coring assembly into a wellbore. The coring assembly including an outer core barrel and an inner core barrel disposed within the outer core barrel. The inner core barrel has an upper end, a lower end opposite the upper end, and a core sample chamber extending axially from the lower end. In addition, the method comprises (b) capturing a core sample from the subterranean formation within the sample chamber. Further, the method comprises (c) raising the coring assembly to the surface after (b). Still further the method comprises (d) contacting a formation fluid in the sample chamber with at least one detector during (c). Moreover, the method comprises (e) detecting the presence of a formation acid gas in the formation fluid with the at least one detector during (c).

24 Claims, 6 Drawing Sheets

APPARATUS AND METHODS FOR DETECTING GASES DURING CORING OPERATIONS

CROSS-REFERENCE TO RELATED APPLICATIONS

This application claims benefit of U.S. provisional patent application Ser. No. 61/322,548 filed Apr. 9, 2010, and entitled "Method to Detect Acid Gases (H2S) During Drilling and Coring Operations," which is hereby incorporated herein by reference in its entirety.

STATEMENT REGARDING FEDERALLY SPONSORED RESEARCH OR DEVELOPMENT

Not applicable.

BACKGROUND

1. Field of the Invention

The invention relates generally to apparatus and methods for identifying gases within formation fluids obtained from a subterranean formation. More particularly, the invention relates to apparatus and methods for identifying and quantifying the amount of acid gases such as hydrogen sulfide (H2S) and carbon dioxide (CO2) in such formation fluids.

2. Background of the Technology

Hydrocarbon fluids such as oil and natural gas are obtained from a subterranean geologic formation, i.e., a reservoir, by drilling a wellbore that penetrates the reservoir. Once a wellbore has been drilled, the well must be completed before hydrocarbons can be produced from the well. A well completion involves the design, selection, and installation of equipment and materials in or around the wellbore for conveying, pumping, and/or controlling the production or injection of fluids. After the well has been completed, production of oil and gas can begin.

In the construction of hydrocarbon production, processing and transportation facilities, it is often desirable to know the type and concentration of gases contained within the formation fluids in order to select the appropriate materials for the design of wellbore facilities. For example, it is advantageous to know whether corrosive materials, such as acid gases like hydrogen sulfide (H2S) and carbon dioxide (CO2), are contained within the formation fluids since an underestimate of such gases can impact well economics and lead to premature equipment and piping failures. This is particularly true with H2S gas since it is highly corrosive and toxic. Further, more recently it has been observed that the proportion of H2S within formation fluids is increasing, as a result of accessing deeper and more technically challenging formations and where the hydrocarbon deposits tend to be of lesser quality.

Conventionally, downhole formation fluid samples are taken for chemical and physical analysis. Such samples of formation fluid, also known as reservoir fluid, are typically collected as early as possible in the life of a reservoir for analysis at the surface and, more particularly, in specialized laboratories. The information that such analysis provides is vital in the planning and development of hydrocarbon reservoirs, as well as in the assessment of a reservoir's capacity and performance. However, when analyzing such samples later on the surface, those in the art recognize that the measured values may not be representative of the actual values in that some of the formation fluids (e.g., H2S gas) may react with metals used in downhole tools to obtain such samples. In addition, residual amounts of drilling fluids left in the wellbore or near wellbore area of the formation often contain chemical agents that comingle with the sampled formation fluids acquired with conventional tools. This may be particularly problematic with H2S gas because drilling fluids typically contain chemicals that scavenge and neutralize such acid gases. Moreover, in some wells it may not be possible to use some conventional fluid sampling tools due to very high pressures and temperatures, especially in those wells currently being drilled to extreme depths in the Gulf of Mexico.

Accordingly, there remains a need in the art for apparatus and methods for identifying the presence and concentration of certain gases in hydrocarbon formation fluids. Such apparatus and methods would be particularly well-received if they offered the potential to obviate or mitigate at least one or more of the aspects associated with the aforementioned disadvantages.

BRIEF SUMMARY OF THE DISCLOSURE

These and other needs in the art are addressed in one embodiment by a method for detecting the presence of an acid gas in a formation fluid from a subterranean formation. In an embodiment, the method comprises (a) lowering a coring assembly into a wellbore. The coring assembly including an outer core barrel and an inner core barrel disposed within the outer core barrel. The outer core barrel has a lower end comprising an annular coring bit, and the inner core barrel has a central axis, an upper end, a lower end opposite the upper end, and a core sample chamber extending axially from the lower end. In addition, the method comprises (b) capturing a core sample from the subterranean formation within the sample chamber of the inner core barrel. Further, the method comprises (c) raising the coring assembly to the surface after (b). Still further, the method comprises (d) contacting a formation fluid in the sample chamber with at least one detector during (c). Moreover, the method comprises (e) detecting the presence of a formation acid gas in the formation fluid with the at least one detector during (c).

These and other needs in the art are addressed in another embodiment by a coring apparatus for acquiring a core sample from a subterranean formation. In an embodiment, the apparatus comprises an outer core barrel having a longitudinal axis, first end, and a second end opposite the first end, the second end comprising an annular core bit. In addition, the apparatus comprises an inner core barrel coaxially disposed within the outer core barrel. The inner core barrel has a first end, a second end opposite the first end, and a core sample chamber extending axially from the lower end of the inner core barrel. Further, the apparatus comprises a gas detector coupled to the inner core barrel proximal the upper end of the inner core barrel. The gas detector is exposed to the core sample chamber and is configured to detect the presence of an acid gas.

These and other needs in the art are addressed in another embodiment by a method for detecting the presence of an acid gas in a formation fluid from a subterranean formation. In an embodiment, the method comprises (a) lowering a coring assembly into a borehole. The coring assembly including an outer core barrel and an inner core barrel disposed within the outer core barrel. The outer core barrel has a lower end comprising an annular coring bit, and the inner core barrel has a longitudinal axis, an upper end, a lower end opposite the upper end, and a core sample chamber extending axially from the lower end. In addition, the method comprises (b) drilling into the subterranean formation at a bottom of the borehole with the coring bit. Further, the method comprises (c) capturing a core sample from the subterranean formation within the sample chamber during (b). Still further, the method comprises (d) raising the coring assembly to the surface after (c). Moreover, the method comprises (e) liberating the hydrogen sulfide gas from the core sample during (d). The method also comprises (f) allowing the liberated hydrogen sulfide gas to migrate to an upper portion of the sample chamber during (d) axially disposed between the core sample and the upper end of the inner core barrel. In addition, the method comprises (g) detecting the presence of the hydrogen sulfide gas during (c) or (d).

Thus, embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
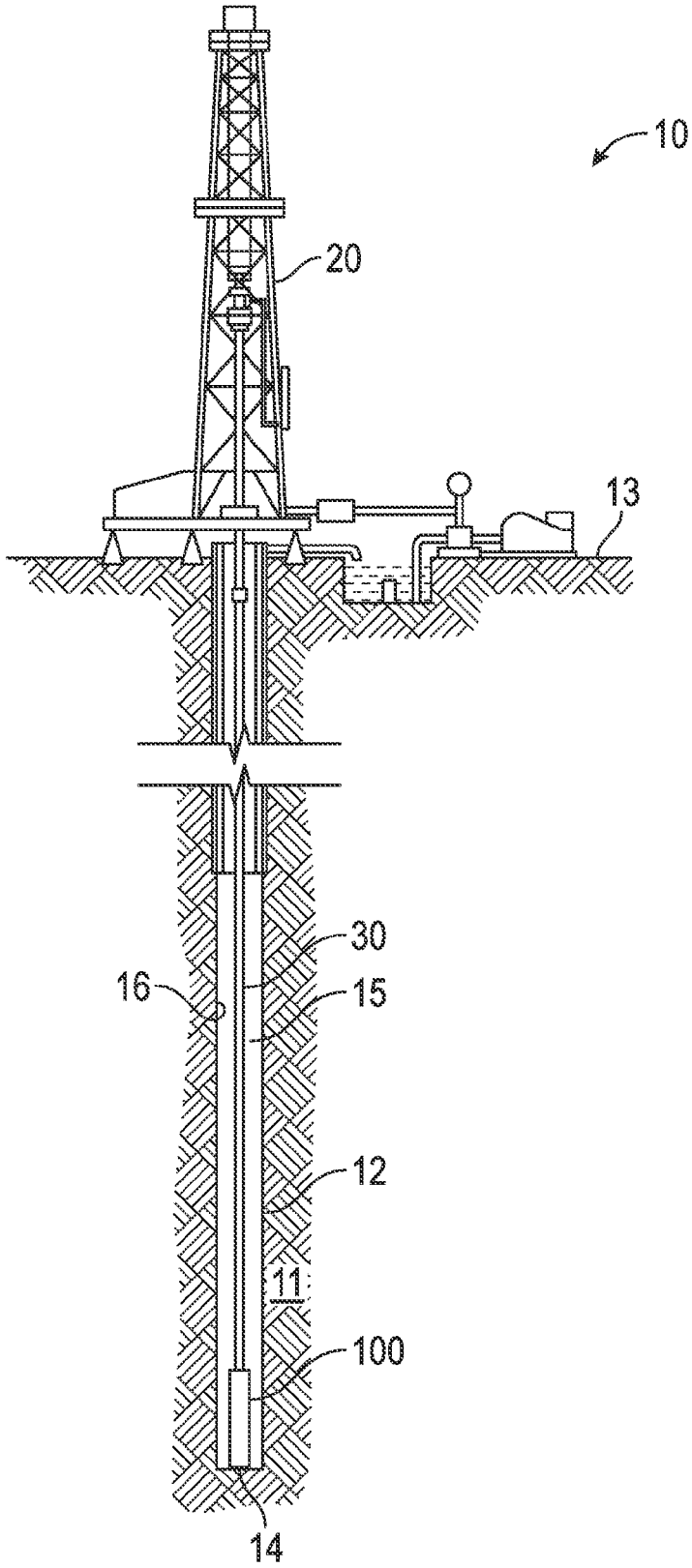
FIG. 1 is a schematic view of a core drilling system including an embodiment of a coring assembly in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

In exploration and development wells, it is important to understand the composition of the formation fluids to select the appropriate materials and design for the production, processing and transportation facilities associated with the well. In particular, the presence and concentration of corrosive acid gases such as H2S and CO2 may significantly impact the selection of materials for such facilities (e.g., casing). Accordingly, embodiments described herein are directed to core drilling apparatus and methods for identifying the presence and/or concentration of formation gases such as H2S and CO2 in a core sample taken from a formation of interest.

Referring now to FIG. 1, a core drilling system 10 for acquiring a core sample from a formation 11 traversed by a borehole 12 is shown. Borehole 12 is formed in a conventional manner by an earth boring drill bit (e.g., rolling cone bit, fixed cutter bit, etc.) mounted on the lower end of a drill string. The drill bit is rotated by rotating the drill string at the surface or by actuation of downhole motors or turbines, or by both methods. With weight applied to the drill string, the rotating drill bit engages the earthen formation and proceeds to form borehole 12 along a predetermined path through formation 11. Once borehole 12 has been drilled to a depth at which it is desired to take a sample of formation 11, the drill string and drill bit are removed from borehole 12 and drilling system 10 is employed to acquire a core sample from formation 11.

Core drilling system 10 includes a drilling rig 20 at the surface 13, a drill string 30, and a coring assembly 100 coupled to the lower end of drill string 30. After borehole 12 is formed as described above, drill string 30 and assembly 100 are lowered into borehole 12 to bottomhole 14. Rotation of drill string 30 causes coring assembly 100 to cut a core sample from formation 11 at the bottomhole 14. During the coring operations, drilling fluid or mud is pumped down drill string 30 and directed out of coring assembly 100. The drilling fluid is forced from bottomhole 12 to the surface through the annulus 15 radially disposed between drill string 30 and borehole sidewall 16. After the core sample has been cut, drill string 30 and coring assembly 100, with the core sample retained therein, are removed from borehole 12 to the surface 13 where coring assembly 100 is separated from drillstring 30 and the core sample can be analyzed.

Figure 2:
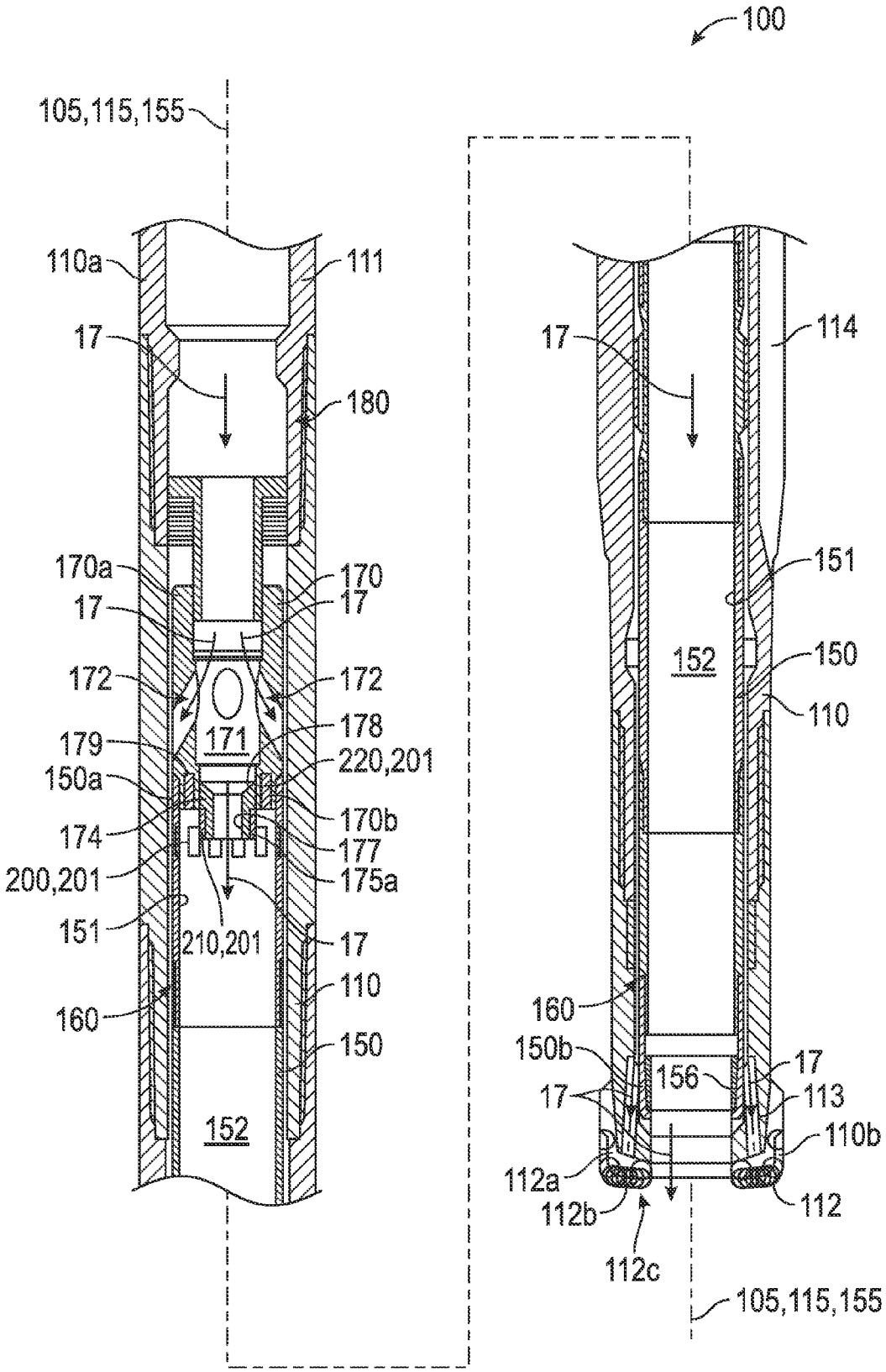
FIG. 2 is a an enlarged schematic cross-sectional view of the coring assembly of FIG. 1 in the "run-in" configuration.
Figure 3:
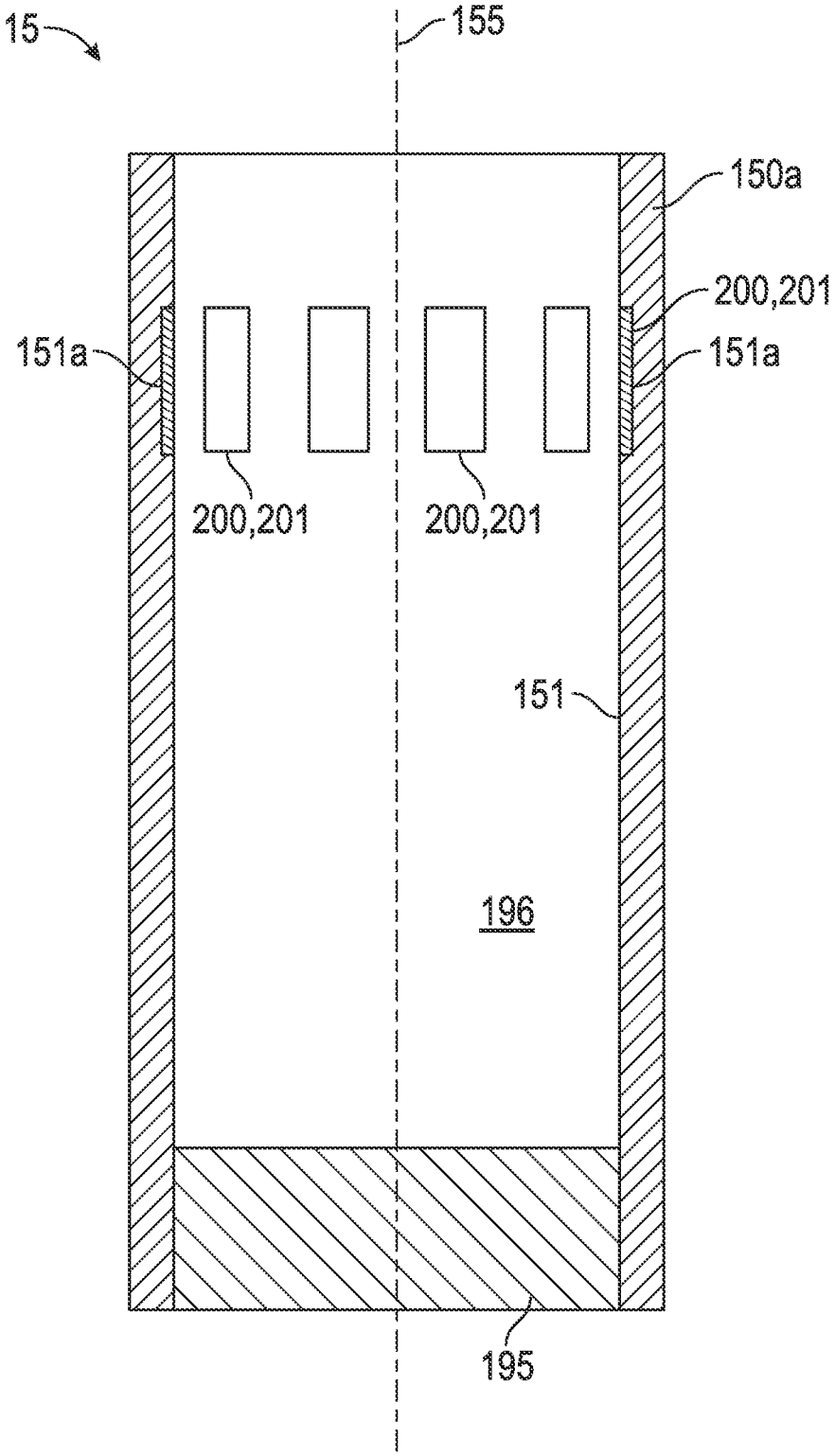
FIG. 3 is a partial cross-sectional view of the upper end of the inner core barrel of FIG. 2.

Referring now to FIG. 2, an embodiment of coring assembly 100 is shown. Coring assembly 100 has a central or longitudinal axis 105 and includes an outer core barrel 110 and an inner core barrel 150 coaxially disposed within outer core barrel 110. Inner core barrel 150 is rotationally and axially moveable relative to outer core barrel 110 as is known in the art. An annular clearance or annulus 160 is provided between core barrels 110, 150 for the circulation of drilling fluid therebetween.

Outer core barrel 110 has a central or longitudinal axis 115 coincident with axis 105, a first or upper end 110*a*, and a second or lower end 110*b* opposite upper end 110*a*. Upper end 110*a* comprises a box end 111 for threadably coupling outer core barrel 110 and assembly 100 to a mating pin end at the lower end of drill string 30. Lower end 110*b* of outer core barrel 110 comprises an annular core bit 112 for cutting a core sample from formation 11 at bottomhole 14. Bit 112 includes a bit body 112*a* having a bit face 112*b* that supports a cutting structure 112*c*. In addition, a plurality of flow passages 113 extend from the radially inner surface of outer core barrel 110 proximal lower end 110 to bit face 112*b*. As will be described in more detail below, during coring operations with assembly 100, drilling fluid is pumped down drill string 30 from the surface 13 to flow passages 113, which distribute the drilling fluid around cutting structure 112*c* to flush away formation cuttings and remove heat from bit 112. The drilling fluid returns to the surface 13 via annulus 15.

A plurality of circumferentially spaced stabilizers 114 extend radially outward from outer core barrel 110. During coring operations, outer core barrel 110 is rotated about axes 105, 115 by drillstring 30 as weight-on-bit (WOB) is applied, thereby enabling core bit 112 to cut a cylindrical core sample from bottomhole 14 of formation 11. While drilling, stabilizers 114 engage borehole sidewall 16, maintain the radial position of assembly 100 within borehole 12, and reduce bit vibrations.

Referring still to FIG. 2, inner core barrel 150 is completely disposed within outer core barrel 110, and has a central or longitudinal axis 155 coincident with axes 105, 115, a first or upper end 150*a*, a second or lower end 150*b* opposite upper end 150*a*, and a radially inner surface 151 extending axially between ends 150*a, b*. Inner surface 151 defines a core sample chamber 152 extending axially from lower end 150*b* to upper end 150*a*. As will be described in more detail below, during coring operations, the core sample cut by core bit 112 is coaxially received into sample chamber 152. A wedge-shaped annular core catcher 156 is coaxially disposed in inner core barrel 150 at lower end 150*b*. Core catcher 156 retains the core sample received into sample chamber 152 as assembly 100 is removed to the surface after coring operations.

Although a wedge-shaped core catcher (e.g., catcher 156) is provided in this embodiment, in other embodiments, a closure member may be coupled to the lower end of the inner core barrel (e.g., lower end 150*b* of inner core barrel 150) to close off and seal the lower end after the core sample is received into the sample chamber (e.g., sample chamber 152), thereby retaining the core sample within the sample chamber as the coring assembly (e.g., assembly 100) is removed to the surface. Such a closure member preferably has an "open" position radially withdrawn from the sample chamber, and a "closed" positioned extending across the lower end of the inner core barrel and closing off the sample chamber at the lower end of the inner core barrel. During run in and coring operations, the closure member is in the open position so that the core sample may be received into the sample chamber through the lower end of the inner core barrel. However, once core drilling is complete and the core sample is completely received within the sample chamber, the closure member is transitioned to the closed position, thereby closing the lower end of the inner core barrel, sealing the sample chamber at lower end of the inner core barrel, and retaining the core sample within the inner core barrel. Examples of suitable closure members are described in U.S. Pat. No. 4,258,803, which is hereby incorporated herein by reference in its entirety.

Referring still to FIG. 2, a drilling fluid distributor 170 is disposed within outer core barrel 110 and is coupled to upper end 150*a* of inner core barrel 150. Flow distributor 170 is coaxially aligned with core barrels 110, 150, and has a first or upper end 170*a*, a second or lower end 170*b* opposite upper end 170*a*, and a central through bore 171 extending between ends 170*a, b*. In addition, flow distributor 170 includes a plurality of circumferentially spaced flow passages 172 extending from bore 171 to annulus 160. Bore 171, flow passages 172, and annulus 160 are in fluid communication with drill string 30. Thus, drilling fluid pumped down drill-string 30 flows through bore 171, passages 172, and annulus 160 to flow passages 113 at lower end 110*b* for cooling bit 112 and flushing cuttings away from bottomhole 14.

Figure 4:
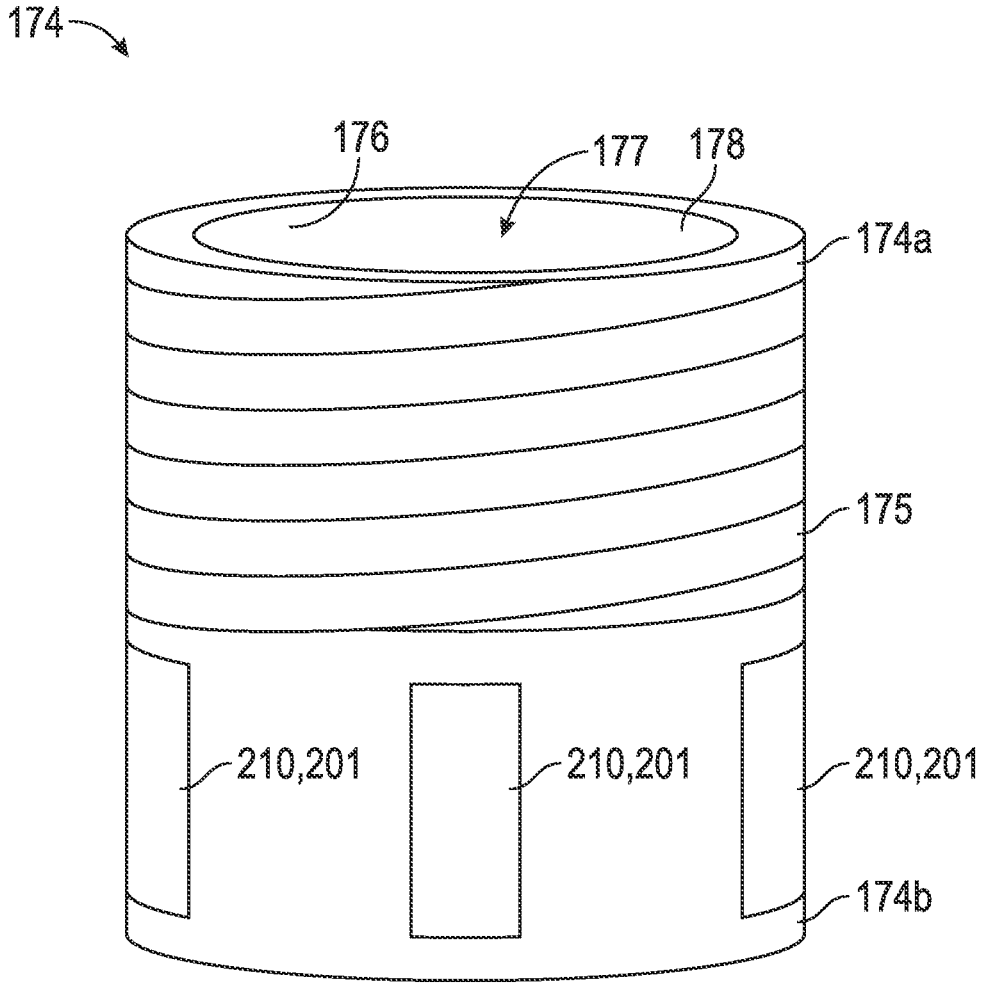
FIG. 4 is an enlarged perspective view of the pressure relief plug of FIG. 2.

Referring now to FIGS. 2 and 4, a cylindrical pressure relief plug 174 is partially received by bore 171 at lower end 170*b*. In particular, plug 174 has a first or upper end 174*a* disposed in bore 171, a second or lower end 174*b* extending axially from bore 171 and lower end 170*b*, a radially outer surface 175 extending between ends 174*a, b*, and a radially inner surface 176 defining an axial flow passage 177 extending between ends 174*a, b*. Radially inner surface 176 includes a frustoconical seat 178 at upper end 174*a*. Seat 178 is sized and configured to receive a ball 190 (FIGS. 5 and 6) that restricts and/or prevents fluid flow through passage 177. In this embodiment, plug 190 is a ball, however, in other embodiments, the plug (e.g., plug 190) may be a dart or other suitable device. Prior to seating ball 190 in plug seat 178, passage 177 and sample chamber 152 are in fluid communication with bore 171 and drill string 30. Thus, before closing passage 177, drilling fluid pumped down drill string 30 flows through bore 171, flow passage 177, sample chamber 152, and lower end 150*b* to bottomhole 14. However, when ball 190 is seated in seat 178, passage 177 and sample chamber 152 are sealed and isolated from bore 171 and drill string 30. Thus, when ball 190 engages seat 178, drilling fluid pumped down the drill string 30 is restricted and/or prevented from flowing through passages 177 into sample chamber 152. In general, once ball 190 is disposed within distributor 170, its position will depend on the pressure differential between bore 171 and sample chamber 152—when the fluid pressure in bore 171 is greater than the fluid pressure in chamber 152, ball 190 will engage seat 178, however, when the fluid pressure in chamber 152 is greater than the fluid pressure in bore 171, ball 190 will disengage seat 178 and allow the relatively high pressure fluid in chamber 152 to vent into bore 171, thereby relieving pressure within chamber 152.

Referring again to FIG. 2, inner core barrel 150 is rotatably and axially moveable relative to outer core barrel 110. In general, any suitable apparatus or assembly known in the art may be provided to allow barrel 150 to rotate and move axially within barrel 110. In this embodiment, a swivel assembly 180 is coupled to upper end 170*a* of distributor 170 and outer core barrel 110. Swivel assembly 180 allows inner core barrel 110 to rotate about axis 105 relative to outer core barrel 150 while axially supporting inner core barrel 150 and distributor 170.

Figure 5:
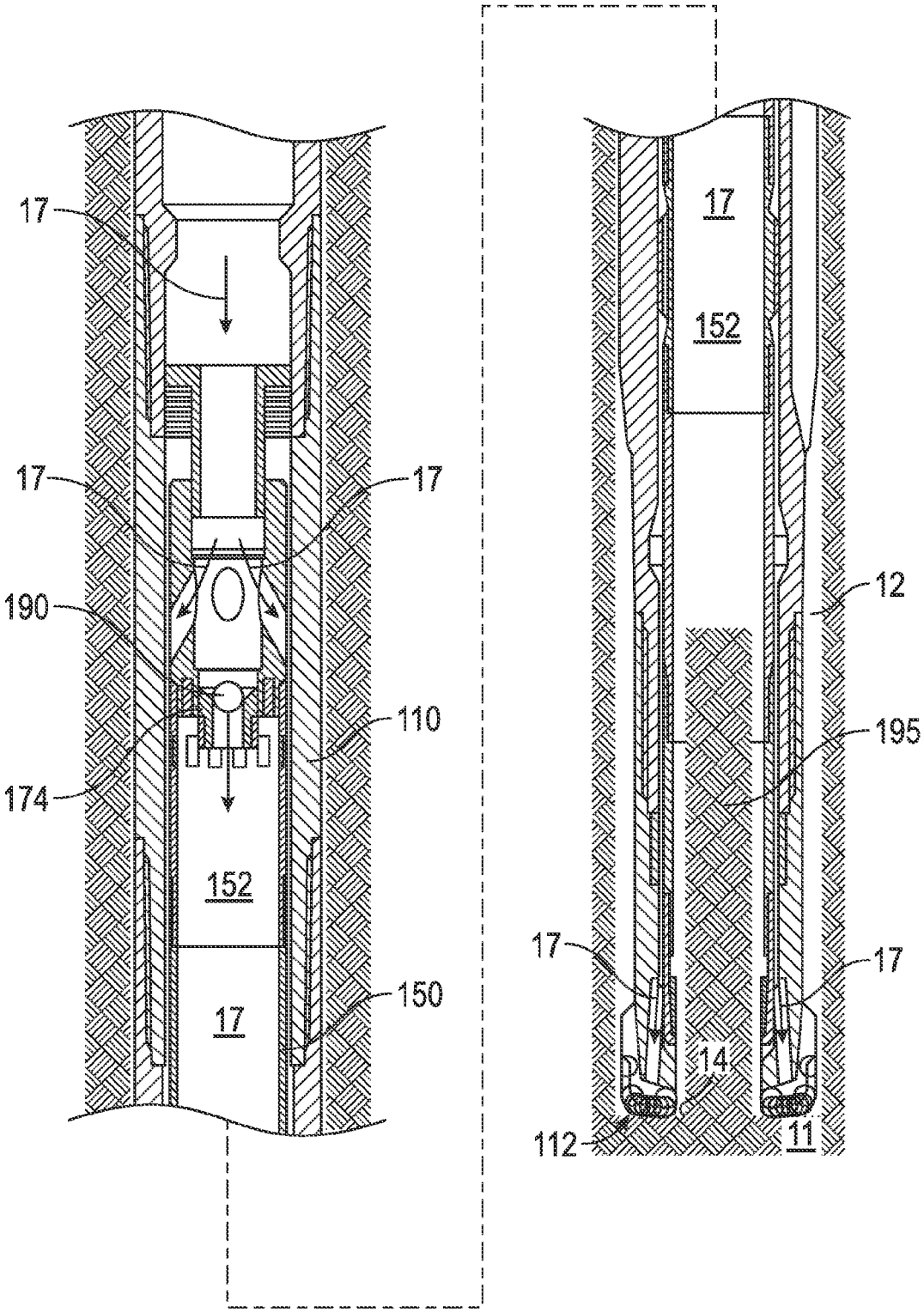
FIG. 5 is a schematic cross-sectional view of the coring assembly of FIG. 1 cutting a core sample from the formation.

Referring now to FIGS. 1, 2, and 5, coring assembly 100 is operated in a conventional manner to acquire a core sample 195 from formation 11 at bottomhole 14. As best shown in FIGS. 1 and 2, assembly 100 is lowered into borehole 12 on the lower end of drill string 30 with passage 177 open (i.e., ball 190 is not disposed in bore 171) and closure member 156 withdrawn (i.e., lower end 150*b* and sample chamber 152 are open to borehole 12). As assembly 100 is being run into borehole 12 to bottomhole 14, drilling fluid, denoted with reference numeral 17, is pumped down drill string 30 and into flow distributor 170, where it is divided into a first flow path through passage 172, annulus 160 and passages 113 to bottomhole 14, and a second flow path through passage 177 and sample chamber 152 to bottomhole 14. The drilling fluid 17 flowing through sample chamber 152 during run-in prevents debris from entering sample chamber 152 prior to commencement of coring operations. In addition, drilling fluid 17 may continue to be circulated through sample chamber 152 for a period of time after assembly 100 is "on-bottom" to ensure a "clean" sample chamber 152 prior to drilling with bit 112.

Moving now to FIG. 5, immediately before drilling begins, a ball or ball 190 is dropped down drill string 30 from the surface 13. Ball 190 moves down drill string 30 under the influence of gravity and the flowing drilling fluid 17 through distributor 170 to pressure relief plug 174, where it engages mating annular seat 178, thereby blocking the flow of drilling fluid 17 through passage 177 into sample chamber 152. With ball 190 sufficiently seated, all the drilling fluid 17 pumped down drill string 30 is then diverted through flow passages 172, annulus 160, and passages 113 to bit face 112*b*.

Referring still to FIG. 5, drilling is commenced by rotating coring bit 112 with drill string 30. With weight-on-bit (WOB) applied, annular cutting structure 112*c* engages formation 11 and cuts a cylindrical core sample 195 from formation 11 at the bottomhole 14. As bit 112 advances axially into formation 12, core sample 195 advances axially into sample chamber 152. While drilling, drilling fluid 17 is pumped down drill string 30 and directed out of bit 112 via passages 172, annulus 160, and passages 113. When the desired amount of core has been taken as determined by measurements at the surface 13 (e.g., based on the axial distance advanced by drill string 30 during drilling as measured at the surface 13), rotation of drill string 30 and bit 112 is stopped. Next, core sample 195 is separated from formation 11 at its lower end and closure member 156 is closed in conventional manners, thereby sealing and retaining core sample 195 within sample chamber 152 at the downhole formation pressure at bottomhole 14.

It should be appreciated that only a small amount, if any, drilling fluid 17 enters sample chamber 152 during coring since ball 190 blocks the flow of drilling fluid through passage 177, and core sample 195 blocks the flow of drilling fluid from bottomhole 14 into sample chamber 152 at lower end 150*b*. Further, as core sample 195 is axially advanced into sample chamber 152 during coring, it compresses any drilling fluid 17 in chamber 152. The drilling fluid 17 displaced by core sample 195 is forced out of chamber 152 via pressure relief plug 174 (i.e., when the pressure of drilling fluid in sample chamber 152 exceeds the pressure of drilling fluid in bore 171, ball 190 is momentarily unseated from seat 178 and drilling fluid within sample chamber 152 is allowed to exit chamber 152 via passage 177) and/or forced out of lower end 150*b* of inner core barrel radially between core sample 195 and inner surface 151. Thus, after coring, substantially all of the drilling fluid 17 within sample chamber 152 after coring is disposed at the upper end of chamber 152 between core sample 195 and distributor 170.

Figure 6:
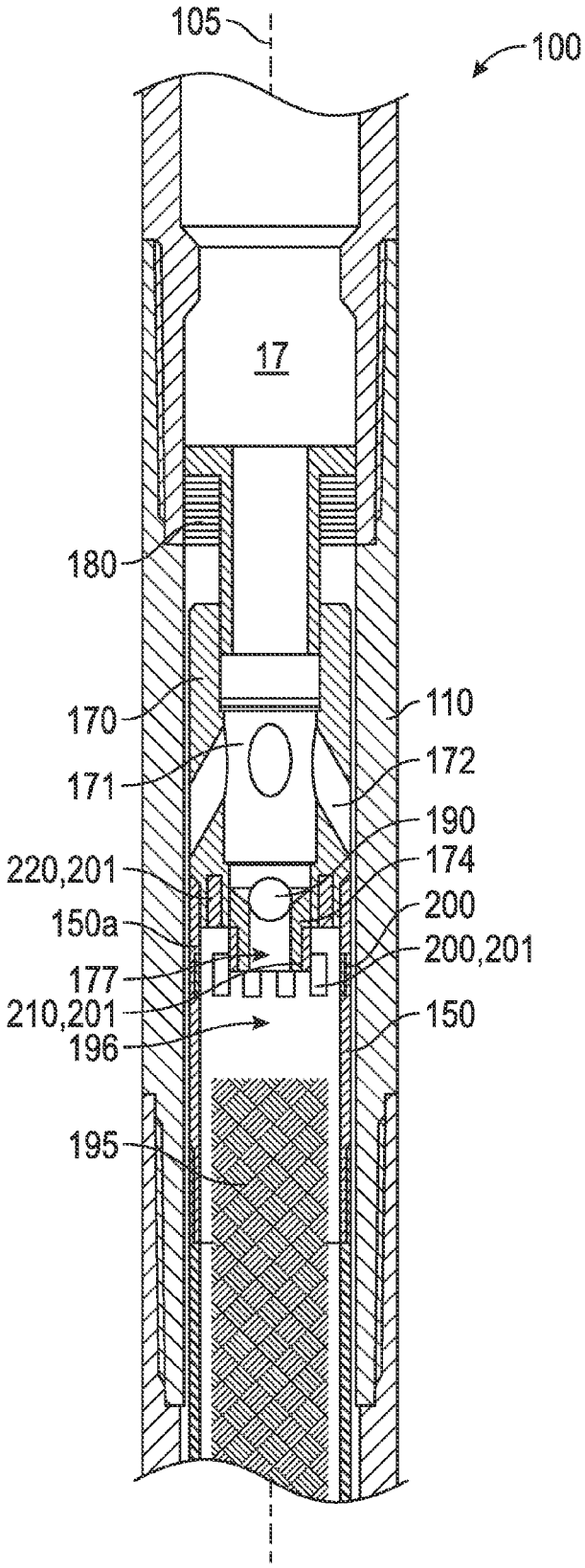
FIG. 6 is a partial schematic cross-sectional view of the core sample of FIG. 3 disposed within the core sample chamber of the coring assembly of FIG. 1 during removal to the surface.

Referring now to FIG. 6, with core sample 195 secured within sample chamber 152, coring assembly 100 is removed from borehole 12 to the surface 13. As assembly 100 and core sample 195 are progressively lifted towards the surface 13, the pressure applied to ball 190 by the column of drilling fluid 17 decreases (e.g., the height of the column of mud in drill string 30 decreases as assembly 100 is raised). However, formation sample 195 and any drilling fluid 17 within chamber 152 were captured at the relatively high pressure at bottomhole 14. Thus, as assembly 100 is raised to the surface 13, the pressure in sample chamber 152 will begin to exceed the pressure of drilling fluid 17 in drill string 30 acting on ball 190, thereby lifting ball 190 from seat 178 and allowing the pressure in sample chamber 152 to be relieved through passage 177 of pressure relief plug 174. As the pressure in sample chamber 152 decreases, compressed formation fluids (e.g., liquids and gases) in core sample 195 may expand, migrate from core sample 195, and rise upward within sample chamber 152, thereby displacing at least some of the drilling fluid 17 in the upper portion of chamber 152 and urging it out of chamber 152 via passage 177 of pressure relief plug 174. As a result, a gas cap 196 consisting substantially of the formation gases liberated from core sample 195 forms at the upper portion of sample chamber 152, axially between core sample 195 and distributor 170.

As previously described, drilling fluid often includes chemicals that scavenge and neutralize certain gases such as acid gases (e.g., H2S). However, since the formation fluids in core sample 195 continue to expand, migrate from sample 195, and urge the drilling fluid out of sample chamber 152, the formation gases in gas cap 196 experience limited, if any, exposure to drilling fluid. Accordingly, the formation gases in gas cap 196 and in the formation fluids liberated from core sample 195 provide a relatively undisturbed sample of formation gases minimally affected by drilling fluid and associated scavenging chemicals. To take advantage of the relatively undisturbed formation gases in gas cap 196, embodiments described herein include a plurality of gas sensors or detectors 200 positioned at upper end of sample chamber 152 to identify the presence and concentration of certain formation gases within gas cap 196 and the formation fluids liberated from core sample 195.

Referring now to FIGS. 2-4 and 6, in this embodiment, coring assembly 100 includes a plurality of circumferentially spaced gas detectors 200 disposed along inner surface 151 of inner core barrel 150 at the upper end of sample chamber 152 (FIGS. 2 and 3); a plurality of circumferentially spaced gas detectors 210 disposed along radially outer surface 175 of pressure relief plug 174 axially below distributor 170 (FIGS. 2 and 4); and a plurality of circumferentially spaced gas detectors 220 positioned at lower end 174*b* of distributor 170. In this embodiment, detectors 200 are seated in radially extending recesses 151*a* on inner surface 151 of inner core barrel 150 and are disposed at the same axial position along inner core barrel 150; detectors 210 are seated in radially extending recesses 175*a* on outer surface 175 of distributor 174 are disposed at the same axial position along distributor 174; and detectors 220 are seated in axially extending recesses 179 in lower end 174*b* of distributor 174. However, in other embodiments, one or more of the detectors (e.g., detectors 200, 210, 220) may be secured to its corresponding component (e.g., inner core barrel 150, pressure relief plug 174) without being disposed in a recess.

As best shown in FIG. 6, gas detectors 200, 210, 220 are positioned at or proximal upper end 150*a* and distributor 170 for exposure to the formation fluids liberated from core sample 195 (e.g., formation gases in gas cap 196). In other words, detectors 200, 210, 220 are positioned such that they will be axially disposed above core sample 195 within sample chamber 152 following coring operations. In general, detectors 200, 210, 220 are exposed to formation gases liberated from the core or formation at any time during or after the coring process. A first opportunity for exposure to formation gases occurs during the cutting of core sample 195 with core bit 112, and a second, potentially greater, opportunity for exposure to formation gases occurs while pulling assembly 100 from borehole 12. As previously described, during this process any formation gases contained in the reservoir fluids within core sample 195 expand, rise to the top of sample chamber 152*a*, and form gas cap 196 where detectors 200, 210, 220 are located.

In general, each gas detector 200, 210, 220 may comprise any suitable device for detecting or identifying the presence and/or concentration (e.g., ppm or range of estimate ppm) of one or more specific formation gases at the anticipated temperature and pressure conditions in the formation. More specifically, each gas detector 200, 210, 220 preferably comprises a suitable device for detecting or identifying the presence and/or concentration of one or more specific formation acid gases such as H2S or CO2. Detectors 200, 210, 220 may comprise active or passive detection devices. For example, as will be described in more detail below, one or more detectors 200, 210, 220 may comprise passive coupons made of materials that react in the presence of a particular gas. As another example, one or more detectors 200, 210, 220 may comprise active, real time detectors that detect the presence and/or concentration of a particular gas, and then communicate that information to the surface via mud pulse telemetry or wired pipe. Thus, as used herein, the term "detector" refers to a device capable of identifying the presence and/or concentration of one or more particular formation gases at the temperature and pressure conditions in the formation.

In this embodiment, each gas detector 200, 210, 220 comprises a coupon 201 configured to detect the presence of an acid gas, and in particular H2S, in the formation gases disposed within gas cap 196. As is known in the art, coupons (e.g., coupons 201) are metal tags with a propensity to tarnish in the presence of a predetermined concentration (e.g., 10 ppm or more) of a particular gas. For example, a coupon may be a sample of metal that does not react, unless exposed to H2S. More specifically, coupons are metal tags that react in the presence of a predetermined partial pressure of a particular gas, which is a function of the gases concentration (e.g., ppm) multiplied by its pressure (e.g., psi). Thus, the concentration of the gas can be calculated by dividing the predetermined partial pressure of the coupon by the actual borehole pressure. Typically, the maximum borehole pressure is used for the actual borehole pressure in calculating or estimating the concentration of the particular gas. Accordingly, as used herein, the predetermined concentration of a particular gas at which the coupon reacts or tarnishes (i.e., the coupon rating) is the predetermined partial pressure of the particular gas at which the coupon reacts or tarnishes divided by the maximum borehole pressure.

Coupons are commercially available from various sources, such as Metal Samples/Cortest Instrument Systems, a Division of Alabama Specialty Products, Inc. located at 156 Metal Samples Rd., Munford, Ala. 36268. Potential metals may include: MONEL® alloy 400 (UNS N04400), 70-30 cupronickel (UNS C71500), 90-10 cupronickel (UNS C70600) as well as others reactive to hydrogen sulfide. These materials also include iron-chromium alloys—5Cr, 9Cr and 12Cr steels; 316 stainless steel; Nickel alloy 200,INCOLOY® alloy 600 and alloy B (a nickel/molybdenum alloy). Other examples of metals that may be used for coupons are disclosed in U.S. Pat. No. 7,025,138, which is hereby incorporated herein by reference in its entirety for all purposes. Thus, as used herein, the term "coupon" refers to a passive detector for identifying the presence and/or concentration of an acid gas such as H2S. In this embodiment, each coupon 201 includes a contact surface exposed to gas cap 196 and the formation gases therein. The contact surfaces comprise a material configured to react with a range of concentrations of acid gases such as H2S.

As previously described, a plurality of detectors 200, 210, 220, and hence coupons 201 in this embodiment, are provided to estimate the presence and/or concentration of an acid gas such as H2S in gas cap 196. Specifically, different coupons 201 are configured to react with H2S over different predetermined ranges of H2S concentrations so that a quantitative determination of the H2S content can be made. For example, a first coupon 201 may be configured to react with H2S at a relatively low concentration of H2S (e.g., between about 0 and 5 ppm H2S), a second coupon 201 may be configured to react with H2S at a moderate concentration of H2S (e.g., between about 10 and 20 ppm H2S), and a third coupon 201 may be configured to react with H2S at a relatively high concentration of H2S (e.g., between about 25 and 100 ppm H2S). Thus, the presence of H2S can be observed and a quantitative analysis of the H2S content can be obtained based on an optically observed change in the tarnish level of the first, second, and third coupons 201 at the surface 13. For example, if the first and second coupon 201 are tarnished, but the third coupon 201 is not tarnished, the presence of H2S has been identified and its approximate concentration is about 10 to 20 ppm. For embodiments described herein, each coupon 201 is preferably configured to detect the presence of H2S and concentration of H2S over a 10 to 20 ppm range (e.g., 5 to 15 ppm, 30 to 40 ppm, 50-70 ppm, etc.) Further, the plurality of coupons 201 are preferably configured to react over different concentration ranges of H2S spanning from about 5 ppm to 500 ppm H2S, and more preferably about 5 to 100 ppm H2S.

Tarnishment of one or more coupons 201 when viewed at the surface indicates that coupon 201 was exposed to a certain predetermined concentration or range of concentrations of a specific gas. Thus, in embodiments described herein, coupons 201 are reviewed for an optical indicator, i.e., a characteristic level of tarnish on the coupon 201, at the surface 13 so that a determination of the presence and/or concentration of H2S or other acid gas can be made. As previously described, H2S or other acid gas in the formation fluids may contact coupons 201 during core cutting, or after core sample 195 is cut while coring assembly 100 is pulled from borehole 12 to the surface 13.

In the manner described, embodiments of systems, apparatus, and methods described herein are particularly useful when a core sample is desired and obtained during the drilling of a well to produce hydrocarbon fluids from a hydrocarbon bearing reservoir. By using embodiments of coring assembly 100 disclosed herein, it is possible to obtain an early indication and/or concentration of H2S or other acid gas content in the formation fluids. This information can then be used in interpretation of mud logs, identify any potential drilling changes, identify any changes to the wireline evaluation program, and to aid in the material selection and design of wellbore related hardware. It should also be appreciated that embodiments of coring assembly 100 may also be employed in relatively extreme temperature and pressure environments that may not be possible with existing technology, such as a downhole fluid sampling tool like the Schlumberger MDT tool referenced in U.S. Pat. No. 7,025,138. Moreover, since this MDT tool typically acquires a fluid sample including formation fluids as well as drilling mud, which may be laced with chemical H2S scavengers to prevent the release of H2S at surface, analysis of the formation gases at the surface may not provide a reliable indicator of the presence and/or concentration of H2S in the formation fluids.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A method for detecting the presence of an acid gas in a formation fluid from a subterranean formation, the method comprising:

(a) lowering a coring assembly into a wellbore, the coring assembly including an outer core barrel and an inner core barrel disposed within the outer core barrel, wherein the outer core barrel has a lower end comprising an annular coring bit, and wherein the inner core barrel has a central axis, an upper end, a lower end opposite the upper end, and a core sample chamber extending axially from the lower end;

(b) flowing drilling fluid through the sample chamber and out the lower end of the inner core barrel;

(c) restricting the flow of drilling fluid through the sample chamber and the lower end of the inner core barrel after step (b);

(d) capturing a core sample from the subterranean formation within the sample chamber of the inner core barrel during step (c);

(e) raising the coring assembly to the surface after step (d);

(f) contacting a formation fluid in the sample chamber with at least one detector during step (e); and (g) detecting the presence of a formation acid gas in the formation fluid with the at least one detector during step (e).

2. The method of claim 1, wherein step (d) comprises rotating the coring bit to drill the formation and form the formation core sample;

wherein step (e) further comprises liberating the formation fluid from the core sample during (e);

wherein step (f) further comprises forming a gas cap within the sample chamber axially between the core sample and the upper end, wherein the gas cap comprises the formation acid gas;

wherein step (g) further comprises detecting the presence of the formation acid gas in the gas cap with the at least one detector.

3. The method of claim 2 wherein the formation acid gas is selected from the group consisting of hydrogen sulfide or carbon dioxide.

4. The method of claim 1, further wherein step (g) further comprises determining or estimating a concentration of the formation acid gas with the at least one detector.

5. The method of claim 1, wherein the at least one detector is attached to a radially inner surface of the inner core barrel.

6. The method of claim 1, wherein the coring assembly further includes a pressure relief plug extending into the core sample chamber at the upper end of the inner core barrel, wherein the pressure relief plug has an upper end, a lower end, a radially outer surface, a radially inner surface defining a flow passage extending between the upper end and the lower end of the pressure relief plug;

wherein the at least one detector is attached to a radially outer surface of the pressure relief plug.

7. The method of claim 1, wherein the at least one gas detector comprises a plurality of gas detectors for detecting the presence of the formation acid gas in the formation fluid.

8. The method of claim 7, wherein the formation acid gas comprises hydrogen sulfide and each gas detector comprises a coupon having a contact surface and comprised of a material selectively reactive with hydrogen sulfide upon contact with the contact surface to form an optical indicator on the contact surface;

wherein step (f) comprises exposing the contact surface of each coupon to the hydrogen sulfide in the gas cap.

9. The method of claim 8, further comprising:

(h) inspecting the optical indicator on the contact surface of each coupon at the surface to determine the presence of hydrogen sulfide in the gas cap.

10. The method of claim 8, wherein a first of the plurality of coupons comprises a material selectively reactive with hydrogen sulfide over a first range of hydrogen sulfide concentrations, and a second of the plurality of coupons comprises a material selectively reactive with hydrogen sulfide over a second range of hydrogen sulfide concentrations that is different from the first range.

11. A coring apparatus for acquiring a core sample from a subterranean formation, the apparatus comprising:

an outer core barrel having a longitudinal axis, first end, and a second end opposite the first end, the second end comprising an annular core bit;

an inner core barrel coaxially disposed within the outer core barrel, wherein the inner core barrel has a first end distal the annular core bit, a second end proximal the annular core bit, and a core sample chamber extending axially from the second end of the inner core barrel, wherein the core sample chamber is configured to receive the core sample;

an annulus radially disposed between the outer core barrel and the inner core barrel;

a drilling fluid distributor coupled to the first end of the inner core barrel, wherein the drilling fluid distributor includes a first flow path extending axially through the drilling fluid distributor to the core sample chamber and a second flow path extending radially from the first flow path through the distributor to the annulus;

a gas detector coupled to the inner core barrel proximal the first end of the inner core barrel, wherein the gas detector is exposed to the core sample chamber and is configured to detect the presence of an acid gas.

12. The apparatus of claim 11, wherein the gas detector is attached to a radially inner surface of the inner core barrel.

13. The apparatus of claim 11, further comprising a pressure relief plug extending axially into the core sample chamber at the first end of the inner core barrel, wherein the pressure relief plug has a first end, a second end extending into the core sample chamber, a radially outer surface extending between the first end and the second end, and a flow passage extending axially between the first end and the second end;

wherein the gas detector is attached to the radially outer surface of the pressure relief plug proximal the second end of the pressure relief plug.

14. The apparatus of claim 11, further comprising a flow distributor coupled to the first end of the inner core barrel, wherein the flow distributor has a first end, a second end opposite the first end, a through bore extending between the first end and the second end, and a plurality of circumferentially spaced flow passages extending from the through bore to an annulus between the inner core barrel and the outer core barrel;

wherein the gas detector is attached to the second end of the flow distributor.

15. The apparatus of claim 11, further comprising a plurality of gas detectors, wherein each gas detector is coupled to the inner core barrel proximal the upper end of the inner core barrel, is exposed to the core sample chamber, and is configured to detect the presence of an acid gas selected from the group consisting of hydrogen sulfide and carbon dioxide.

16. The apparatus of claim 15, wherein each gas detector is a coupon having a contact surface comprises of a material selectively reactive with hydrogen sulfide upon exposure to hydrogen sulfide.

17. The apparatus of claim 16, wherein a first of the plurality of coupons comprises a material selectively reactive with hydrogen sulfide over a first range of hydrogen sulfide concentrations, and a second of the plurality of coupons comprises a material selectively reactive with hydrogen sulfide over a second range of hydrogen sulfide concentrations that is different from the first range.

18. A method for detecting the presence of hydrogen sulfide gas in a formation fluid from a subterranean formation, the method comprising:

(a) lowering a coring assembly into a borehole, the coring assembly including an outer core barrel and an inner core barrel disposed within the outer core barrel, wherein the outer core barrel has a lower end comprising an annular coring bit, and wherein the inner core barrel has a longitudinal axis, an upper end, a lower end opposite the upper end, and a core sample chamber extending axially from the lower end;

(b) drilling into the subterranean formation at a bottom of the borehole with the coring bit;

(c) capturing a core sample from the subterranean formation within the sample chamber during step (b);

(d) raising the coring assembly to the surface after step (c);

(e) liberating the hydrogen sulfide gas from the core sample during step (d);

(f) allowing the liberated hydrogen sulfide gas to migrate to an upper portion of the sample chamber during step (d) axially disposed between the core sample and the upper end of the inner core barrel;

(g) detecting the presence of the hydrogen sulfide gas within the upper portion of the sample chamber during (d).

19. The method of claim 18, further comprising forming a gas cap at the upper portion of the sample chamber with the liberated hydrogen sulfide.

20. The method of claim 18, wherein step (g) comprises exposing a plurality of coupons to the liberated hydrogen sulfide in the upper portion of the sample chamber, wherein each coupon comprises a contact surface made of a material selectively reactive with hydrogen sulfide upon exposure to hydrogen sulfide.

21. The method of claim 20, wherein the material of each coupon is a metal selected from a group comprising chromium, nickel and steel alloys.

22. The method of claim 20, wherein a first of the plurality of coupons comprises a material selectively reactive with hydrogen sulfide over a first range of hydrogen sulfide concentrations, and a second of the plurality of coupons comprises a material selectively reactive with hydrogen sulfide over a second range of hydrogen sulfide concentrations that is different from the first range.

23. The method of claim 20, wherein step (g) comprises tarnishing the contact surface of one or more of the plurality of coupons upon exposure of the coupons to the hydrogen sulfide gas.

24. The method of claim 23, further comprising:

(h) removing the coring assembly from the borehole; and (i) visually inspecting the plurality of coupons to estimate a concentration of the hydrogen sulfide gas.

* * * * *